United States Patent [19]

Hirose

[11] Patent Number: 4,691,648

[45] Date of Patent: Sep. 8, 1987

[54] DEVICE FOR DETECTING THE RESIDUAL AMOUNT OF BOBBIN THREAD IN A LOCK STITCH SEWING MACHINE

[75] Inventor: Tokuzo Hirose, Osaka, Japan

[73] Assignee: Hirose Manufacturing Company, Limited, Osaka, Japan

[21] Appl. No.: 928,592

[22] Filed: Nov. 10, 1986

Related U.S. Application Data

[63] Continuation of Ser. No. 760,978, Jul. 31, 1985, abandoned.

[51] Int. Cl.[4] ..... D05B 19/00; D05B 69/36

[52] U.S. Cl. ..... 112/121.11; 112/273; 112/278

[58] Field of Search ..... 112/271, 278, 121.11, 112/185, 192, 273

[56] References Cited

U.S. PATENT DOCUMENTS

| | | | |
|---|---|---|---|
| 2,251,368 | 8/1941 | Moser | 112/273 |
| 3,928,752 | 12/1975 | Darwin | 112/273 X |
| 4,166,423 | 9/1979 | Brienza | 112/278 X |
| 4,195,292 | 3/1980 | Pulich | 112/278 X |
| 4,569,298 | 2/1986 | Lindh et al. | 112/273 X |

FOREIGN PATENT DOCUMENTS

| | | | |
|---|---|---|---|
| 2444189 | 3/1976 | Fed. Rep. of Germany | 112/121.11 |
| 1352525 | 5/1974 | United Kingdom | 112/273 |
| 2135704 | 9/1984 | United Kingdom | 112/121.11 |

*Primary Examiner*—Wm. Carter Reynolds

*Attorney, Agent, or Firm*—Wenderoth, Lind & Ponack

[57] ABSTRACT

A device for detecting the residual amount of bobbin thread in a lock stitch sewing machine is arranged such that a detector detect the number of rotations of an arm shaft or oscillating shaft, or the number of cycles of vertically reciprocating movement of a needle bar of a lock stitch sewing machine including the arm shaft, and oscillating shaft, and needle bar. The detector provides an output for the detected of rotations. The residual amount of bobbin thread wound on a bobbin in a bobbin case is then detected based on the detected number of rotation output. The detected residual amount of bobbin thread is then compared with a predetermined value which is predetermined in dependence on conditions such as the thread and needle to be employed, and the workpiece.

1 Claim, 7 Drawing Figures

DEVICE FOR DETECTING THE RESIDUAL AMOUNT OF BOBBIN THREAD IN A LOCK STITCH SEWING MACHINE

This application is a continuation of now abandoned application Ser. No. 760,978, filed July 31, 1985 now abandoned.

BACKGROUND OF THE INVENTION

1. Field of the Invention

The present invention relates to a device for detecting the residual amount of bobbin thread in a sewing machine and, more particularly, to a device of the type which is simple in arrangement and permits easy detection of the residual amount of such thread.

2. Description of the Prior Art

Generally, in lock stitch sewing machines, a bobbin on which is wound a bobbin thread is placed in a bobbin case, which in turn is mounted to a shuttle disposed below a bed, which in fact prevents a visual observation of the condition of the bobbin thread in the bobbin. Therefore, it is impossible to know the residual amount of bobbin thread at any time during a sewing operation, and accordingly, sewing is continued until the bobbin thread has run out, that is, until stitches can no longer be formed.

Consequently, a fresh supply of bobbin thread is provided only after sewing is discontinued. Such a lock stitch sewing machine is particularly unsuitable for use in sewing a portion of a workpiece which requires continuous stitches. Indeed, operation of the machine has to be discontinued in the course of sewing, or the sewing work has to be redone from the beginning, which will result in a considerable decrease in sewing work efficiency. For this reason, various means have been proposed in order to permit checking of how much of the bobbin thread has been consumed. There are known sewing machines in which a phototube is used to optically or magnetically observe the surface of the bobbin below the bed. Such a sewing machine has a disadvantage in that components, such as the shuttle and bobbin case, often require special treatment and that the machine involves a high cost of manufacture. Another disadvantage is that operation may be rendered inaccurate by thread fraying, lubricating oil, and the like.

SUMMARY OF THE INVENTION

In order to overcome aforesaid problems, the invention has for its object the provision of a novel and improved device for detecting the residual amount of bobbin thread in a lock stitch sewing machine.

Another object of the invention is to provide a device for detecting the residual amount of such thread which is able to perform an accurate detection of the residual amount of bobbin thread in a lock stitch sewing machine.

With a view to accomplishing the aforementioned objects, a device for detecting the residual amount of bobbin thread in a lock stitch sewing machine according to the present invention comprises: a first means for detecting at least one of the number of rotations of an arm shaft and an oscillating shaft, and the number of cycles of vertically reciprocating movement of a needle bar while a lock stitch sewing machine comprising said arm shaft, oscillating shaft, and needle bar is operating, said first means outputting an output corresponding to the detected number; and a second means for detecting the residual amount of bobbin thread wound on a bobbin in a bobbin case based on the output from said first means and for comparing the detected residual amount of bobbin thread with a first predetermined value, said first predetermined value predetermined in dependence on the conditions of thread and needle employed, and of the workpiece.

In a preferred embodiment, said second means causes the lock stitch sewing machine to stop operating when the detected residual amount of bobbin thread reaches said first predetermined value.

In another preferred embodiment, said second means comprises a light emitting indication element, said light emitting indication element being lit up when the detected residual amount of bobbin thread reaches a second predetermined value which is larger than said first predetermined value at which the lock stitch sewing machine is caused to stop operating.

In still another preferred embodiment, said light emitting indication element remains lit up until the detected residual amount of bobbin thread reaches said first predetermined value at which the lock stitch sewing machine is caused to stop operating.

In a further preferred embodiment, said second means comprises a sounding means, said sounding means being actuated to sound when the detected residual amount of bobbin thread reaches a second predetermined value which is larger than said first predetermined value at which the lock stitch sewing machine is caused to stop operating.

Preferably said sounding means remains actuated to sound until the detected residual amount of bobbin thread reaches said first predetermined value at which the lock stitch sewing machine is caused to stop operating.

In accordance with the invention, the detection of the residual amount of bobbin thread is positively effected at a low-cost.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
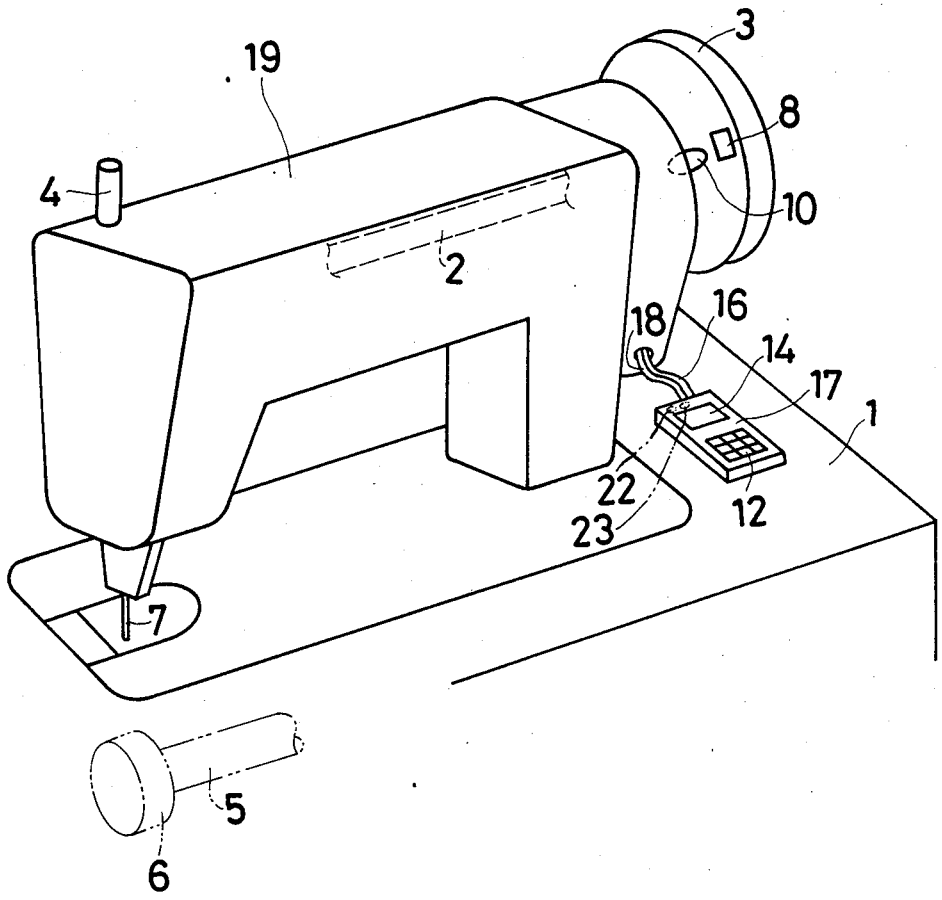
FIG. 1 is a general perspective view showing an embodiment of the invention.

Referring now to the drawings, the preferred embodiments of the present invention are described below.

FIG. 1 is a perspective view schematically showing a lock stitch sewing machine of an embodiment according to the present invention. In an upper portion of a machine body 1 there is provided an arm shaft 2 to which is fixed a pulley 3 known as hand wheel. A needle bar 4 is interlocked with the arm shaft 2 to perform the vertically reciprocating motion. A shuttle 6 is mounted to an oscillating shaft 5 which is interlocked with the arm shaft 2. A needle 7 is mounted to the needle bar 4, with a needle thread passed through the needle 7. A bobbin having a bobbin thread wound thereon is mounted to the shuttle 6.

Now, it is assumed that when the bobbon is full, the amount of bobbin thread thereon is x cm. As the arm shaft 2 makes one rotation, the pulley 3 makes one rotation as well, and accordingly the needle bar 4 makes one cycle of vertically reciprocating movement, with the result that one stitch is formed. Assuming that the amount of bobbin thread consumed in forming one stitch, which is formed by one rotation of the pulley 3, is y cm, and that the number of rotations of the pulley 3 required in consuming one package of bobbin thread is $\alpha$, the number of rotations $\alpha$ of the pulley 3 per package of bobbin thread is:

$$\alpha = x/y \quad (1)$$

Accordingly, the number of rotations $\beta$ of the pulley 3 as made when such an amount as that except for z cm of bobbin thread has been consumed before the bobbin becomes empty, or when a residual amount z cm of bobbin thread is reached, is expressed by the following equation:

$$\beta = (x-z)/y \quad (2)$$

During one rotation of the pulley 3, the arm shaft 2 also makes one rotation, the needle bar makes one cycle of vertically reciprocating movement, and the oscillating shaft 5 makes two rotations.

Inasmuch as certain conditions such as type of bobbin thread used, type of needle 7 used, type of workpiece as cloth, and pitch of or distance between stitches, are same, the amount of bobbin yarn x wound fully on a bobbin and the amount of bobbin yarn y required in forming one stitch are both almost constant. Where value z is set under these condition, the number of rotations $\beta$ of the pulley 3 is directly proportional to $(x-z)/y$, and the aforesaid equation (2) thus holds true. In this way it is possible to know the residual amount of bobbin thread corresponding to the number of rotations $\beta$, and accordingly to stop the operation of the lock stitch sewing mahcine when the predetermined residual value z is reached.

Generally, cotton thread is wound on a bobbin to its fully winding capacity, whereas polyester thread is wound only 80% or so relative to the bobbin capacity. For example, if the bobbin is of an ordinary TA type for straight lock stitch sewing machines, the amount x of thread wound on the bobbin may be determined as being approximately 55–57 m in the case of cotton 60's, and as being approximately 53–54 m in the case of polyester thread 60's. The number of rotations of the pulley 3 required to consume the amount x of bobbin thread is approximately 17,000–20,000 when the thread is cotton, is approximately 18,000–20,000 when the thread is polyester. Therefore, if operation of the sewing machine is to be stopped before the bobbin thread is completely consumed, a value for the residual amount z of bobbin thread may be set at a level corresponding to 500–1,000 rotations of the pulley, for example, and accordingly the operation of the lock stitch sewing machine may be stopped when the number of rotations of the pulley 3 has reached 16,500 or so in the case of cotton thread, or 17,500 or so in the case of polyester thread.

Figure 2:
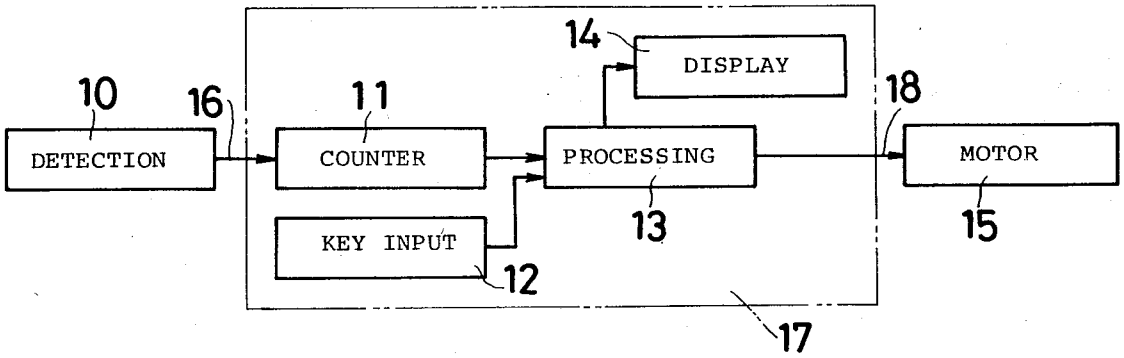
FIG. 2 is a block diagram showing an electrical arrangement of the embodiment of the invention.

FIG. 2 shows a block diagram of an embodiment for detecting such a residual amount of bobbin thread in accordance with the present invention. The pulley 3 has an optical reflective piece 8, such as aluminum foil, fixed thereto. The reflective piece 8 is detected by an optical detector element 10. The optical detector element 10 emits light to the pulley 3 and detects reflected light from the reflective piece 8. An output from the detector element 10 is supplied through a flexible line 16 to a counter 11 by which it is counted. The machine body 1 is provided with key input means 12 which have numbers 0–9 and other pushbuttons for motion control. Signals from the counter 11 and key input means 12 are input to a processing circuit 13 incorporating a microcomputer or the like. Through the operation of the processing circuit 13, an indicator 14 indicates a residual amount of bobbin thread corresponding to an integrated number of rotations of the arm shaft 2, pulley 3, and oscillating shaft 5. The operation of a motor 15 is controlled through an output from the processing circuit 13. The motor 15 actuates the arm shaft 2, pulley 3, and oscillating shaft 5.

In a casing 17 are housed the counter 11, key input means 12, processing circuit 13, and indicator 14. The processing circuit 13 is connected to the motor 15 through the flexible line 18. The casing 17 is preferably of such size as may be gripped by one hand and is of a socalled desk top type electronic calculator construction.

Figure 3:
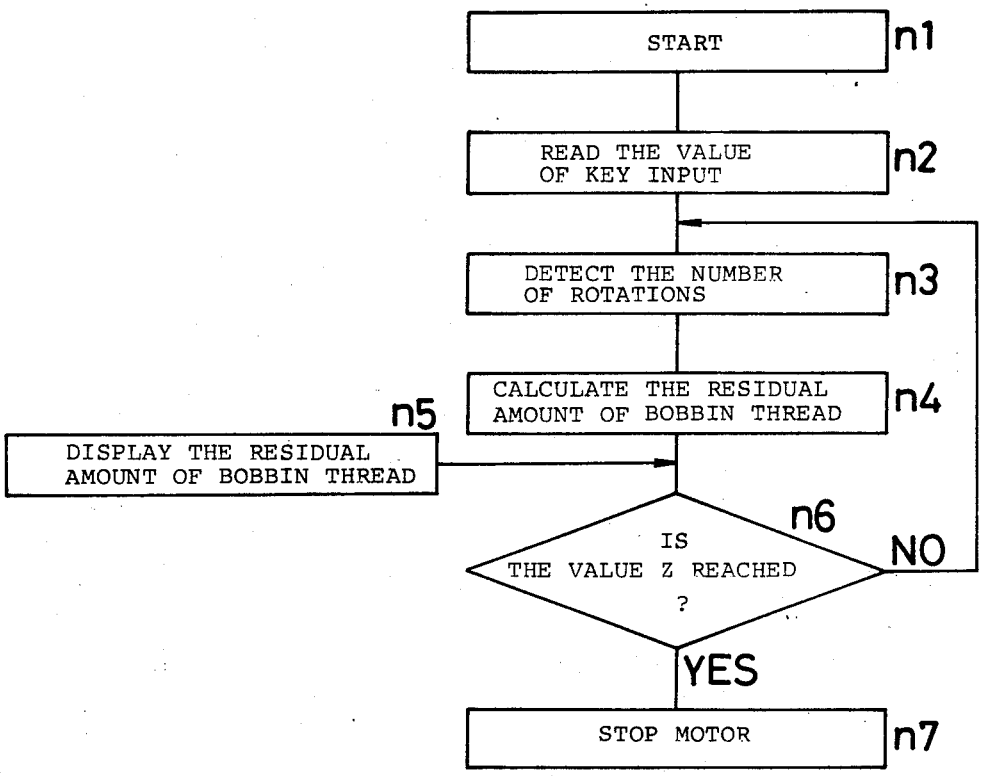
FIG. 3 is a flowchart illustrating the procedures for the arrangement of FIG. 2.

The manner of operation of the processing circuit 13 and the associated components will now be explained with reference to FIG. 3. Operation proceeds from step n1 to step n2, at which the value of key input is read. Values corresponding to predetermined conditions as shown in Table 1 below are input into the processing circuit 13 by the key input means 12.

TABLE 1

| | | Size of bobbin thread (count) | | |
|---|---|---|---|---|
| | | 50 | 60 | |
| Material of bobbin thread | Cotton thread | Z1 | Z2 | . . . |
| | Polyester thread | Z3 | Z4 | . . . |
| | . | | | |
| | . | | | |
| | . | | | |

The value shown in Table 1 corresponds to the residual amount of bobbin thread z (z represents z1–z4 collectively) at which the run of the motor 15 is to be stoppped to stop operation of the lock stitch sewing machine. As stated above, the bobbin mounted to the shuttle 6 has a bobbin thread wound fully thereon, if the thread is cotton, or a bobbin thread wound 80% or so relative to the winding capacity of the bobbin, if the thread is polyester. The residual amount of bobbin thread z at which the motor 15 is to be stopped depends upon such factors as material and size of the bobbin thread. At step n3, the number of rotations of the pulley 3 as detected by the detector element 10 is read. At step n4, a residual amount of bobbin thread corresponding to the number of rotations is calculated. At step n5, the residual amount of bobbin thread is indicated by the indicator 14. At step n6, detection is made as to whether the number of rotations corresponding to the predetermined amount of bobbin thread z has been reached or not, and if the detection is affirmative, operation proceeds to step n7, at which the run of the motor 15 is stopped.

At the indicator 14, the residual amount of bobbin thread corresponding to the number of rotations may be indicated in absolute value, or may be indicated in terms of converted value as calculated against the initial amount of bobbin thread taken as 100 or 1000 and the completely consumed state of bobbin thread taken as zero. In another embodiment, arrangement may be made such that the number of rotations is detected of the arm shaft 2 or of the oscillating shaft 5, or the number of cycles of vertically reciprocating movements of the needle bar 4 is detected. For the purpose of detection, magnetic or other suitable means may be used instead of the optical detector element 10.

Figure 4:
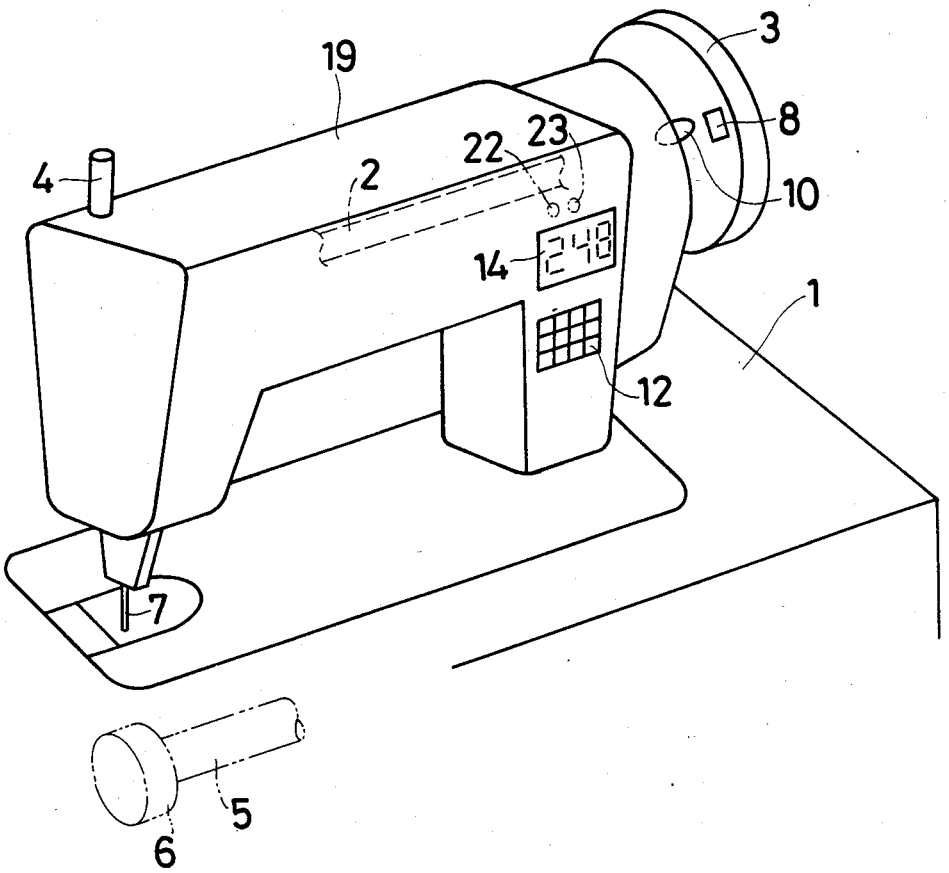
FIG. 4 is a general perspective view of another embodiment of the invention.

FIG. 4 is a general perspective view showing another embodiment of the invention. In an upper housing 19 there are mounted key input means 12 and indicator 14, both exposed outside. The counter 11 and processing circuit 13 are contained in the housing 19. The detector element 10 is connected to the counter 11, and the processing circuit 13 is connected to the motor 15. These and other connections are made within the housing 19.

Figure 5:
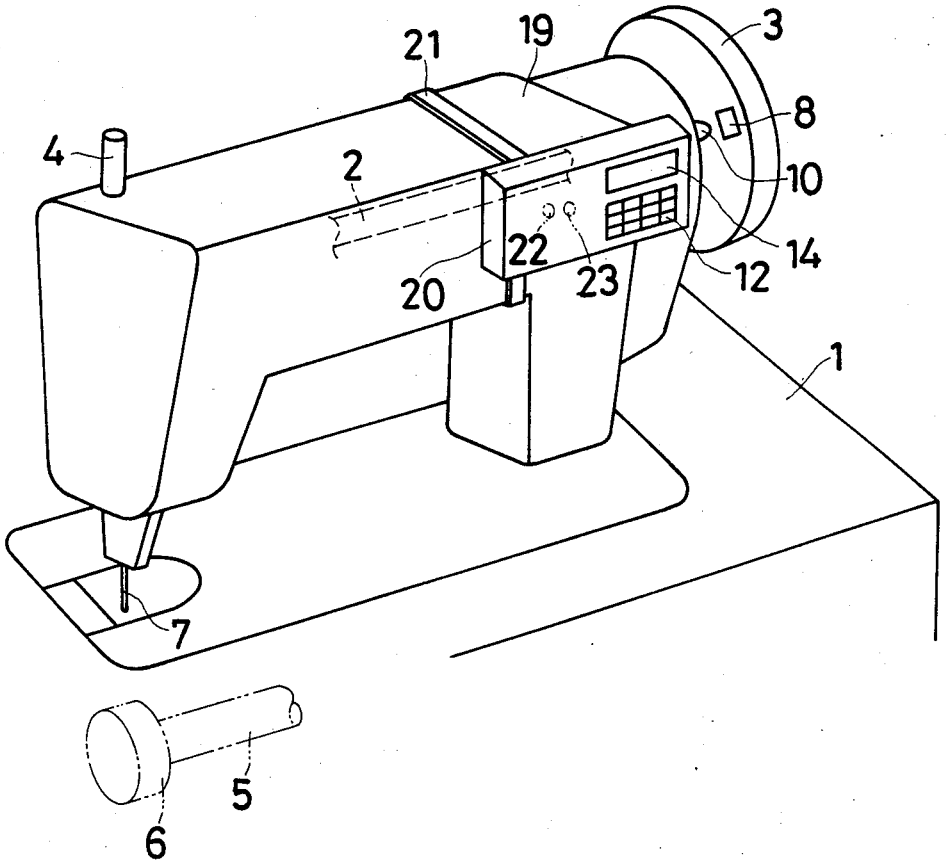
FIG. 5 is a general perspective view of still another embodiment of the invention.

FIG. 5 is a general perspective view of a still another embodiment of the invention. In this embodiment, the detector means 10, counter 11, key input means 12, processing circuit 13, and indicator 14 are all housed in a casing 20, which is removably tied to the housing 19 by means of a mounting belt 21 so that the detector element 10 is positioned so as to face the reflective piece 8. According to this embodiment, the invention may be applied to an existing sewing machine with substantial improvements not being made in the latter.

Figure 6:
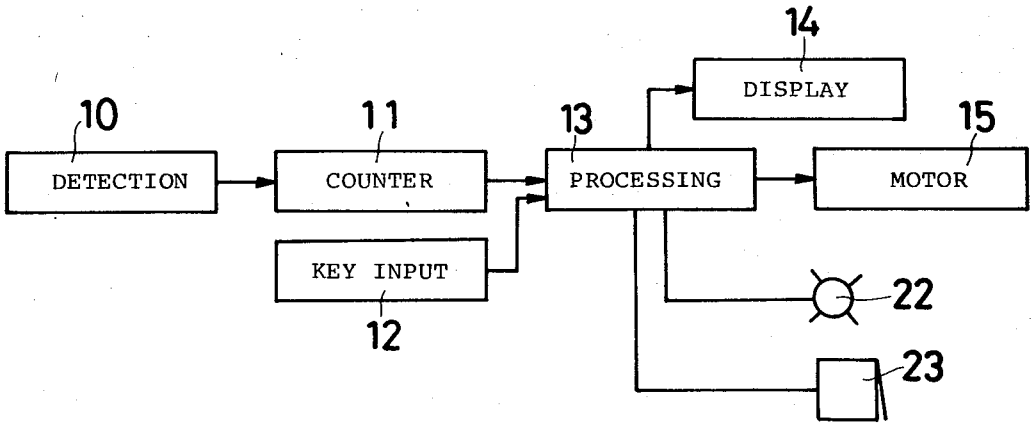
FIG. 6 is a block diagram showing an electrical arrangement of yet another embodiment of the invention.

FIG. 6 is a block diagram showing yet another embodiment of the invention. The processing circuit 13 is connected to a light emitting diode 22 and also to a buzzer 23. The processing circuit 13 actuates the light emitting diode 22 to light up and the buzzer 23 to sound, during a time period of from the time that there is reached a predetermined value $Z_0$ ($Z_0 > Z$) which precedes the arrival of the residual amount of bobbin thread Z and at which sewing is still possible, to the time that the residual amount of bobbin thread Z is reached at which operation of the sewing machine is to be stopped.

By recognizing such a visual indication by the light emitting diode 22 and such acoustic indication by the buzzer 23, therefore, the operator engaged in sewing is able to know that a fresh supply of bobbin thread is needed. Thus, it is possible to replenish the supply of bobbin thread before the residual amount of bobbin thread z is reached and before the operation of the sewing machine is stopped, in order to prevent sewing operation from being stopped at an inconvenient sewing position. The predetermined value Z0 is input to the processing circuit 13 by the key input 12 in the same fashion as that of the predetermined value Z.

Figure 7:
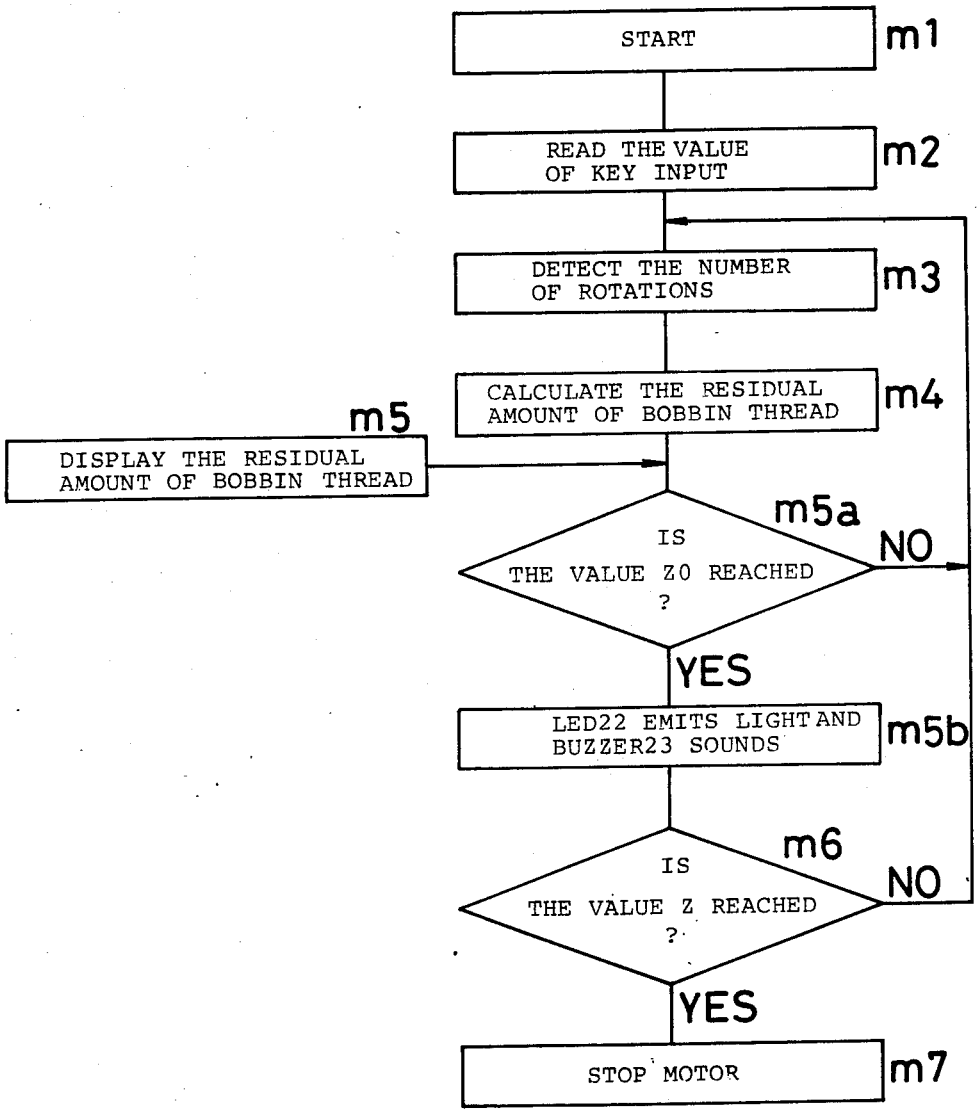
FIG. 7 is a flowchart illustrating the procedures for the arrangement of FIG. 6.

A decision as to whether or not the value $Z_0$ for bobbin yarn has been reached is made after steps m4 and m5 and before step m6, that is, at step m5*a*, as illustrated in the FIG. 7 flowchart. After the decision is made at step m5*a* that the value $Z_0$ has been reached, the light emitting diode 22 emits light and the buzzer 23 sounds at step m5*b*.

Steps m1–m5, m6, and m7 correspond respectively to steps n1–n5, n6, and n7 explained with reference to FIG. 3, and similar operations are performed in both series of steps.

The light emitting diode 22 and the buzzer 23 are both shown by virtual lines in FIGS. 1, 4, and 5. They are mounted on the casings 17 and 20 respectively shown in FIGS. 1 and 5, and on the upper housing 19 in FIG. 4.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A device for detecting the residual amount of bobbin thread in a lock stitch sewing machine comprising:

a first means for detecting the number of rotations of an arm shaft of said sewing machine and for providing an output corresponding to the detected number of rotations, said first means comprising a light emitter disposed on a housing of said sewing machine and a light detector which is also disposed on said housing for detecting said light emitted from said light emitter after being reflected off of an optical reflector disposed on a side portion of a pulley affixed to said arm shaft;

a second means for detecting the residual amount of bobbin thread wound on a bobbin in a bobbin case based on said output of said first means and for comparing said detected residual amount of bobbin thread with a first predetermined value, said first predetermined value being predetermined in dependence upon the conditions of a thread and needle employed and of a workpiece, said second means causing said sewing machine to stop operating when said detected residual amount of bobbin thread reaches said first predetermined value;

said second means comprising an indication element consisting of at least one of a light emitting indication element and a sounding means which is activated when said second detected residual amount of bobbin thread reaches a second predetermined value which is larger than said first predetermined value at which said lock stitch sewing machine is caused to stop operating;

wherein said indication element remains activated until said detected residual amount of bobbin thread reaches said first predetermined value at which said lock stitch sewing machine is caused to stop operating;

wherein said second means further comprises a counter for counting said output of said first means and a key input means for manually inputting said first and second predetermined values and a processing means for controlling said sewing machine and said indication element and a display means for displaying a residual amount of bobbin thread;

wherein said second means is disposed in a separate housing disposed apart from said first means and said first and second means are interconnected via a flexible electrical wires.

* * * * *